US005765449A

United States Patent [19]

LeMire

[11] Patent Number: 5,765,449

[45] Date of Patent: Jun. 16, 1998

[54] SPRING LOCKING AND RELEASE APPARATUS FOR KNOBS AND KNOB-LIKE STRUCTURES

[75] Inventor: Paul LeMire, Jacksboro, Tenn.

[73] Assignee: Electric Hardware Corporation, Farmingdale, N.Y.

[21] Appl. No.: 395,388

[22] Filed: Feb. 27, 1995

[51] Int. Cl.[6] ..... G05G 1/12

[52] U.S. Cl. ..... 74/553; 16/121; 16/DIG. 40; 403/229

[58] Field of Search ..... 74/553; 192/43, 192/41 S, 81 C; 403/229, 291, 365, 366; 29/161; 81/177.1, 489; 16/DIG. 30, DIG. 40, 114 R, 121; 464/40

[56] References Cited

U.S. PATENT DOCUMENTS

| | | | |
|---|---|---|---|
| D. 253,686 | 12/1979 | Wooldridge et al. . | |
| D. 289,629 | 5/1987 | Gregory . | |
| 2,638,365 | 5/1953 | Jones | 403/366 |
| 3,429,408 | 2/1969 | Maker | 192/41 S |
| 3,528,315 | 9/1970 | Marquis . | |
| 3,572,284 | 3/1971 | Rattan . | |
| 3,709,339 | 1/1973 | Austin et al. | 192/81 C |
| 3,887,963 | 6/1975 | Harmon et al. . | |
| 4,372,432 | 2/1983 | Waine et al. | 192/43 |
| 4,869,357 | 9/1989 | Batchelder | 192/81 C |
| 4,955,253 | 9/1990 | Sakai et al. . | |
| 4,984,931 | 1/1991 | Struthers et al. . | |
| 5,083,477 | 1/1992 | Geil . | |
| 5,217,438 | 6/1993 | Davis et al. | 403/229 |
| 5,273,229 | 12/1993 | Komatsu | 192/81 C |

FOREIGN PATENT DOCUMENTS

| | | | |
|---|---|---|---|
| 1229991 | 9/1960 | France | 74/553 |

*Primary Examiner*—Charles A. Marmor
*Assistant Examiner*—Mary Ann Battista
*Attorney, Agent, or Firm*—Nolte, Nolte and Hunter, P.C.

[57] ABSTRACT

A pair of coiled springs are mounted in tandem in a housing with their adjacent ends extending radially for retention in a housing permitting slight radial movement of the adjacent ends. The outer ends of the springs extend radially and are axially and circumferentially spaced apart and retained in the housing for slight circumferential movement. The outer ends of the spring are moved by tensioning them in opposite directions to increase the inner diameter of the annulus formed by the springs to receive a shaft upon which the springs tighten when the spring ends are released from tension.

18 Claims, 6 Drawing Sheets

SPRING LOCKING AND RELEASE APPARATUS FOR KNOBS AND KNOB-LIKE STRUCTURES

FIELD OF THE INVENTION

This invention relates generally to mounting knob-like structures to a shaft component and is specifically concerned with rapid locking and release coiled spring apparatus for securing a knob to shaft.

BACKGROUND OF THE INVENTION

Conventionally, knob mounting systems have fallen into two categories. The first category is the push-on system. The push-on system utilizes a light friction interference fit to secure a knob on to a shaft component. The push-on system is convenient to utilize since the knob is simply slid on to the shaft component, however, the knob push-on system can be easily removed with the application of excess thrust and torque load. The second category is the set screw system. The set screw system utilizes a knob or a knob and bushing assembly which is drilled and tapped perpendicular to the axis of the shaft component so that set screws can be tightened against the shaft during assembly.

The set screw system is the more popular of the two conventional knob mounting systems because it provides a mechanically secure assembly. However, there are several negative considerations in this installation, including the cost of manufacturing, the cost of installation, damage to the shaft component, loss of screws during maintenance, loosening of screws resulting from wear, shock or vibration, the need of a specific tool for assembly, maintenance, and the cosmetic design limitations imposed to accommodate set screws.

Thus, it has not been possible heretofore to combine the convenience of a push-on mounting system with the security of a set screw system.

What is needed, therefore, and comprises an important objective of the invention is to provide a shaft mounted knob that incorporates the convenience of the push-on system with the security of the set screw system, while holding or decreasing the cost of manufacturing the finished product; one which can be rapidly locked on and released from the shaft and without the need for special tools during the assembly and maintenance of the knob.

SUMMARY OF THE INVENTION

The present invention provides a knob with rapid locking and release coiled spring apparatus for mounting the knob to a shaft component. As such, the knob incorporates the convenience of the push-on system with the security of the set screw system, while maintaining or decreasing the cost of manufacturing the finished product. The construction is such that the coiled spring apparatus incorporated in a hub structure can be used as a bushing securement to a shaft.

In one embodiment of the present invention, a split cylindrical housing is disposed within a knob body with the split cylindrical housing holding, in tandem, a pair of torsion multi-turn coiled springs defining an annulus extending along a long axis. The springs are closed wound with an inside diameter slightly smaller than the outside diameter of the intended shaft component. Each of the coiled springs have short radial extensions at each end. The radially extended ends, at the inner ends of the springs, are adjacent each other so that they meet and are retained in a restriction aperture in the housing. These radially extended ends are clamped between the split cylindrical housing halves which form the restriction aperture to restrict radial, axial and angular; that is, circumferential movement of the springs.

The outer ends of the torsion multi-turned coiled springs are clocked to break out in angular positions axially spaced apart in near axial alignment, slightly circumferentially spaced apart, when placed on a shaft component, and are captured within a restriction aperture formed as an axially positioned slot along the joinder of the split cylindrical housing walls, 180° from the restriction aperture which retains the inner radial ends of the springs.

Oppositely facing fulcrums are formed centrally of the axially positioned slot and a see-saw lever is placed in the slot between the fulcrums with the lever ends positioned on the outer ends of the springs such that applying pressure to one end of the cam lever in one direction rocks the lever on the fulcrum and causes the other end of the lever to move angularly in the opposite direction. The torsional load applied to the outer ends of the coiled springs by the cam lever action causes the springs to increase in diameter thereby permitting a shaft component to be inserted or withdrawn freely in and from the annulus of the springs during assembly and maintenance of the knob. The release of the torsional load by the cam lever will cause the pair of coiled springs to return to their original size. Thus, the clamping action of the pair of coiled springs on to the shaft component accurately centers the shaft component and limits all displacement to an imperceptible movement.

In the embodiment of the invention just discussed, both the knob body and the split cylindrical housing contain aligned apertures that provide access to the cam lever to move it against the bias of the outer ends of the springs with a small actuating tool.

Instead of a split housing for the springs which is inserted in the knob body, the knob body may be molded or machined to receive the coiled springs and provide for access to the spring ends.

It is the specific object therefore of the invention to provide a rapid locking and release coiled spring apparatus for securing a knob to a shaft component. To accomplish this objective, a spring apparatus is secured around the shaft by virtue of an operator's ability to decrease the inner diameter of the spring to clamp onto the shaft and to increase its inner diameter to release it from the shaft.

Another object of the invention is to provide a pair of coiled springs, in tandem, where one spring transmits torque in a clockwise direction and resists thrust in a push direction, while the other coil spring transmits torque in counterclockwise direction and resists thrust in a pull direction. The securing force is the initial friction force provided by the frictional fit between the outer surface of the shaft and the inner surface of the springs. This force increases as torque and thrust forces are applied in either or both of these directions since these actions tend to tighten either one of the springs about the shaft.

It is also an object of the present invention to minimize the cost of manufacturing and maintaining a knob mounting system. In this connection, the present invention provides facile spring mounting within the knob either via a split cylindrical inner housing or by forming the knob for direct spring mounting and, in either case, providing ready access to the springs for mounting the knob and releasing the knob on and from the shaft.

Also, the tools which move the levers or key bars, for example, which apply circumferential pressure to the outer ends of the springs, which effects the rapid locking and release action of these torsion multi-turn coiled springs during the assembly and maintenance of the knob mounting system are either incorporated in the knob or access to the spring ends is such that even the end of a paper clip may be used to effect movement of the spring ends. In all events, the need for special tools may be eliminated.

The spring, housing and lever structures of the present invention, though disclosed with relation to a knob and shaft system, can be adapted for other systems requiring securement and release of hub-type structures on shafts; e.g., pulleys, gears and the like.

DETAILED DESCRIPTION OF THE PREFERRED EMBODIMENT

Figure 1:
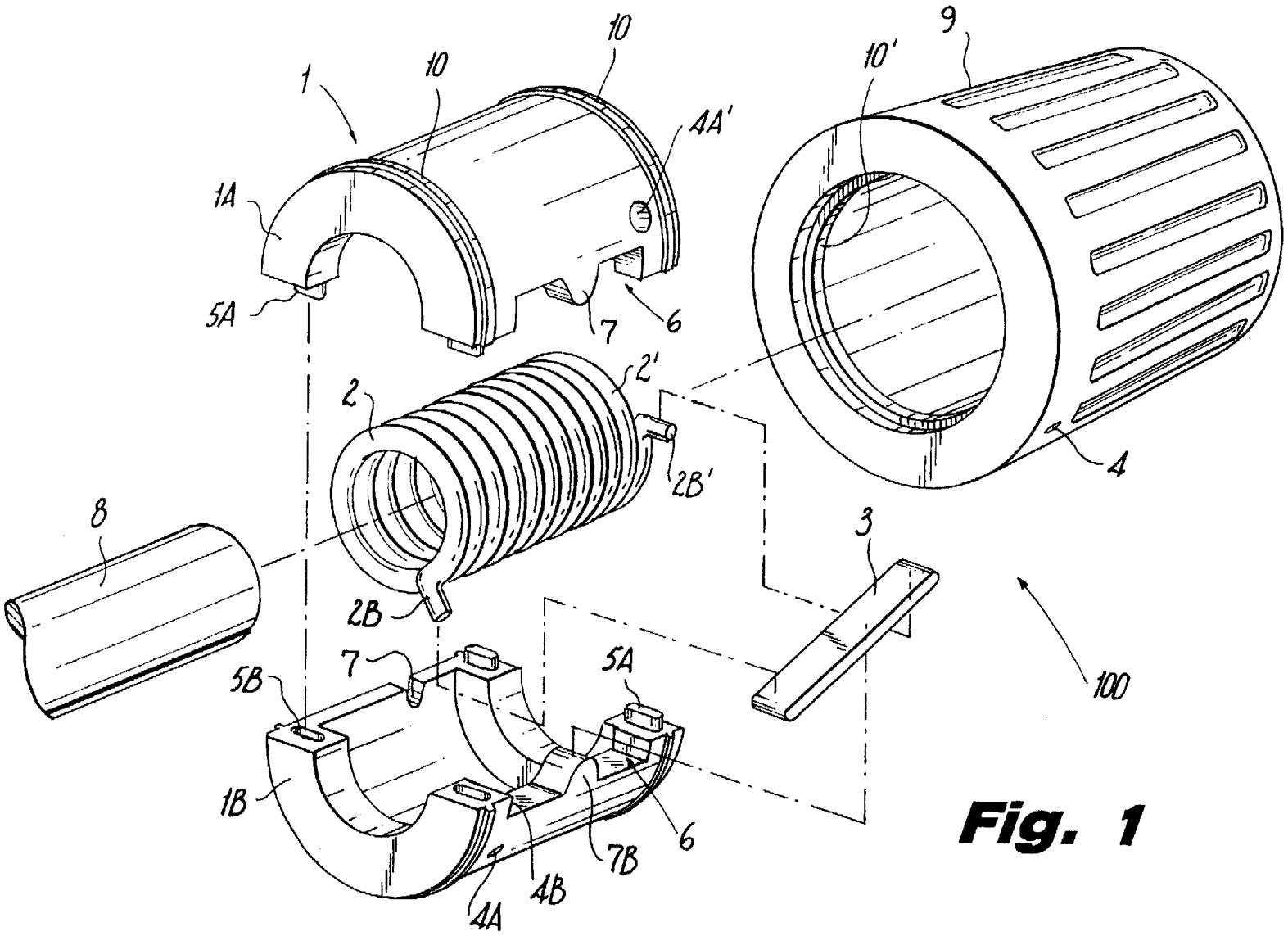
FIG. 1 is an exploded perspective view of a knob made in accordance with the present invention.

Referring now to FIGS. 1–2 and 5–7, a knob 100 comprises a knob outer body 9 with a split cylindrical inner housing 1, comprised of mating halves 1A and 1B, set within the knob body 9 with a pair of torsion multi-turned coiled springs 2, 2' positioned in tandem within the split inner housing. The pair of coiled springs are closed wound with short inner radial extensions 2A, 2A', shown only in FIGS. 5–7, and short outer radial extensions 2B, 2B' and an inside diameter slightly smaller than the shaft component 8 upon which the knob is to be mounted. The inner radial ends 2A, 2A' are adjacent each other at the center of the split cylindrical housing and are clamped by a center restriction aperture 12 formed in the edges of the split cylindrical housing halves (the bottom part of the aperture only shown in FIG. 1) thereby restricting movement of the springs within the inner housing to the necessary radial expansion of the springs and of the inner radial ends shown in dotted lines in FIG. 7 when the diameter of the coils is increased to receive and release the shaft.

Male tabs 5A on the ends of the halves of the cylindrical housing friction fit within female tab receptors 5B on opposing ends of the housing halves.

Interlocking ridges 10, 10' on the inner housing ends and inside ends of the outer housing respectively snap fit to hold the assembled housings and to permit rotation of the housings relative to one another to align access apertures 4, 4A as shall be discussed. Alternatively, the ends of the housings 1 and 9 may be threaded with alignment of the apertures at the end of the threaded lead.

Figure 7:
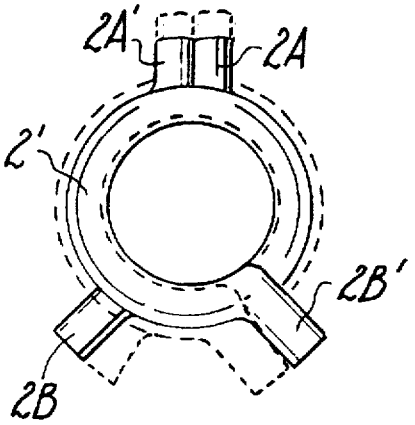
FIG. 7 is an end view of the springs of FIGS. 5 and 6.

The outer radial ends 2B and 2B' of the springs are clocked to break out in an angular position in near axial alignment, as shown in FIG. 7, when placed on the shaft component 8. The split cylindrical housing 1 has an axially positioned slot 6 formed in the adjourning edges of the cylindrical housing walls and opposing fulcrums 7, 7B are formed at the center of the slot 6. The slot accommodates the outer ends 2B and 2B' of the springs 2, 2' when the split cylindrical housing halves are mated together. The opposite ends of a see-saw lever 3 are positioned under one outer spring end 2B and over the other outer spring end 2B' such that applying pressure to the cam lever 3 in a direction at one end causes the other end to move angularly in the opposite direction by virtue of the retention of the middle of the lever between the fulcrums 7, 7B so that the outer radial ends are circumferentially moved toward one another as shown in dotted lines in FIG. 7 to expand the springs.

The torsional load applied to the pair of torsion multi-turned coiled springs by the lever 3 action will cause the diameter of the pair of coiled springs to increase thereby permitting the shaft component 8 to be inserted or withdrawn freely during assembly and maintenance. Similarly, the release of torsional load by the lever 3 will cause the diameter of the pair of springs to return to the original size. The clamping of the pair of coiled springs onto the shaft component 8 accurately centers the shaft component 8 and limits its radial, axial, and angular displacement to an imperceptible movement.

To facilitate movement of the see-saw lever, the knob body 9 and the split cylindrical housing 1 are provided with apertures 4 and 4A–4B which are aligned by rotational movement of the outer and inner housings which must overcome the friction of the tight fit between the ridges of the housing. The apertures extend to the end of the axial slot 6 (as seen in FIG. 1) underlying the end of lever 3 which underlies outer end 2B of spring 2. A similar aperture 4A' (shown only in FIG. 1) in the housing may be provided at the opposite end of the housing giving access to the other end of the lever so that the housing may be inserted into the knob, either end first.

Figure 2:
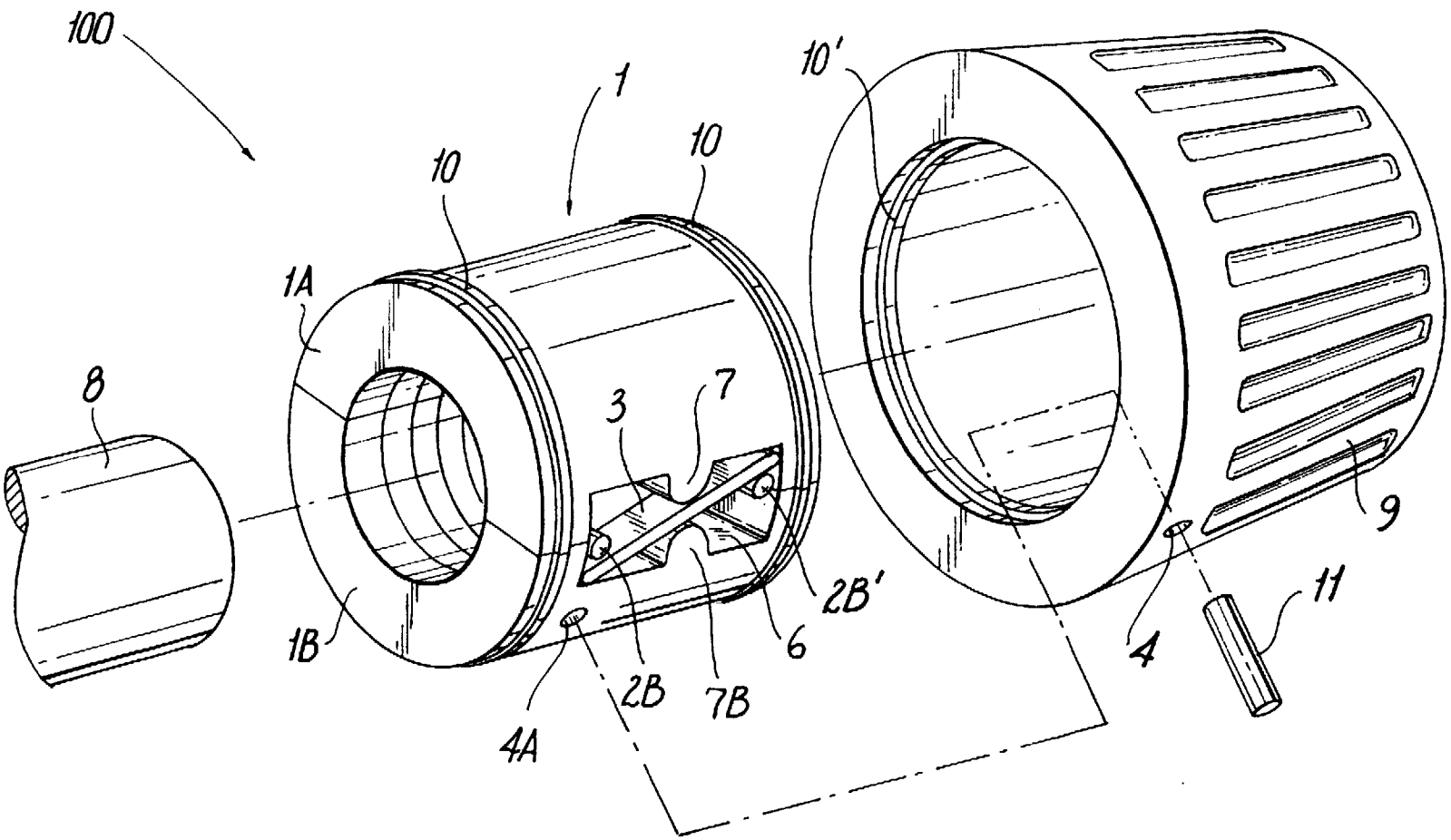
FIG. 2 is an exploded perspective view of the knob of FIG. 1 partially assembled.

When the assembled knob 100 of FIGS. 1 and 2 is to be applied to a shaft 8, a tool 11 (which could be the end of a paper clip), is inserted through apertures 4 and 4A–4B to bear against the end of lever 3 which moves the ends of the outer ends of the coil springs circumferentially toward one another to increase the inner diameter of the springs sufficiently to receive the shaft. When the knob is mounted, the pressure on the lever is released and spring pressure returns the outer spring ends to decrease the inner diameter of the springs to lock the springs and thus the knob on the shaft.

By having the movable outer ends of a spring in the invention circumferentially displaceable toward and away from one another, the "Chinese" finger trap is emulated so that attempted axial movements of the knob and shaft relative to one another is resisted both by the friction between the springs and shaft and rotational movement of the knob is resisted in either direction by tightening of the spring because of shaft/spring friction.

Figure 3:
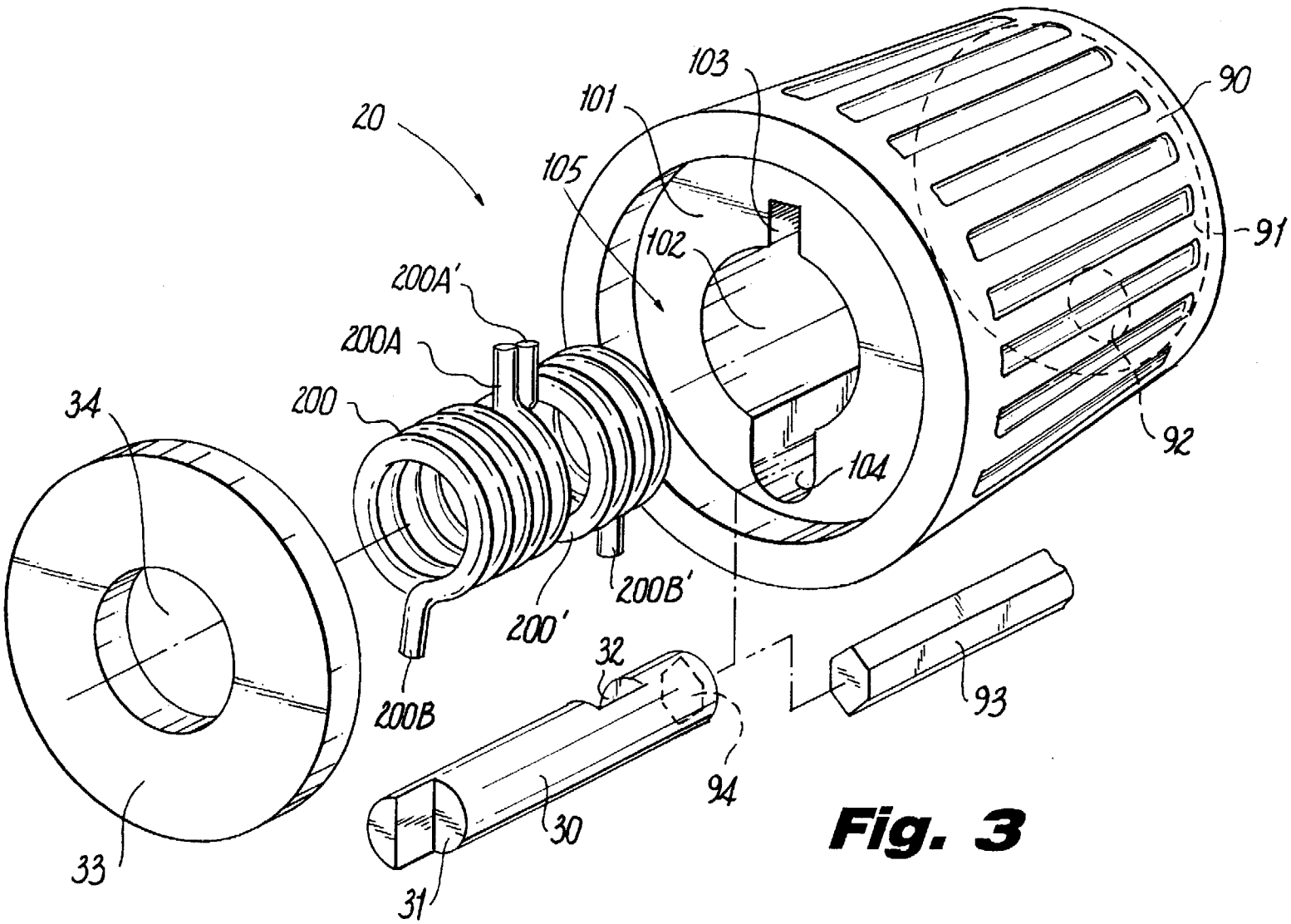
FIG. 3 is an exploded perspective view of a knob incorporating an alternate construction in accordance with the invention.

Referring now to FIG. 3, another preferred embodiment of the present invention, a knob 20, is shown where the outer body portion 90 and inner housing portion 101 are integral and fabricated in one piece with a central bore 102 which accommodates the pair of torsion multi-turned coiled springs 200, 200'. Two axially positioned slots 103 and 104 in communication with the bore, run parallel to the bore and are positioned 180° apart from one another.

The springs 200, 200' are inserted into and retained in the bore and in this instance, their inner radial ends 200A, 200A' are inserted into and retained within axially positioned slot 103 restricting movement of the springs to the necessary expansion thereof to receive and release the shaft 8 (not shown in FIG. 3).

The outer radial extensions 200B, 200B' of the pair of springs 200 and 200', which are slightly circumferentially displaced from one another, are retained within axially positioned slot 104. The slot 104 is larger than the slot 103 to accommodate both the outer radial extensions of the springs and a notched release bar 30 the notches 31, 32 of which face in opposite directions and receive the outer ends of the springs such that applying pressure to the outer spring ends by turning the bar causes the outer spring ends to move in angularly opposite direction to increase the inner diameter of the coiled springs. When turning pressure on the cam is released the spring ends return to their radial positions in slot 104 and the inner diameter of the springs is decreased.

The knob 20 has a rear wall 91 in which an aperture 92 provides access for a hex key 93 to mate with a hex socket 94 in an end of the notched release bar 30 to cause rotational movement of the notched bar. As previously noted, the movement of the notched release bar causes a torsional load on the spring outer ends which increases the diameter of the pair of springs 200–200', thereby permitting a shaft component to be inserted or withdrawn freely to and from within the springs. Removing pressure on the hex key terminates the rotational pressure on the notched release bar and the pair of coiled springs return back to their original diameter clamping securely on to the shaft component.

The knob 20 has a retainer wall 33 with an aperture 34 to accommodate the outside diameter of the shaft. The wall friction fits within space 105 at the inner end of knob 20 where it retains the pair of coiled springs 200 and 200' within the bore 102.

The tandem springs shown in FIG. 3 have coils wound in the same direction. That is, if one were to follow the coils of each spring counterclockwise starting from the left end of the spring, one moves to the right end of the spring.

In another embodiment, the two coils are wound in opposite directions and bar 30 is notched so that the radial extensions at the outer ends of the tandem spring assembly are moved in the same direction.

Figure 8:
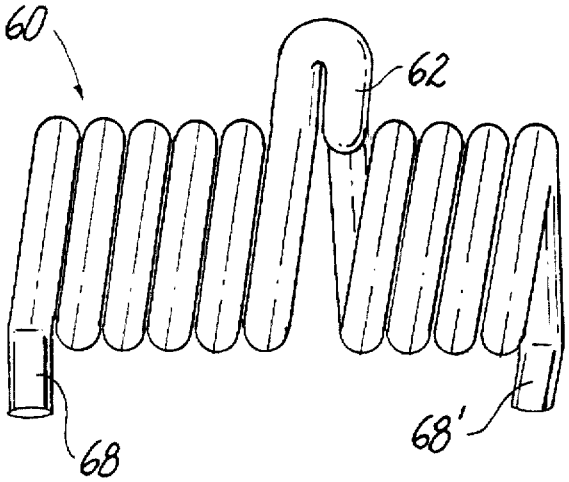
FIG. 8 is a side elevational view of a spring in an alternate construction in accordance with the invention.
Figure 10:
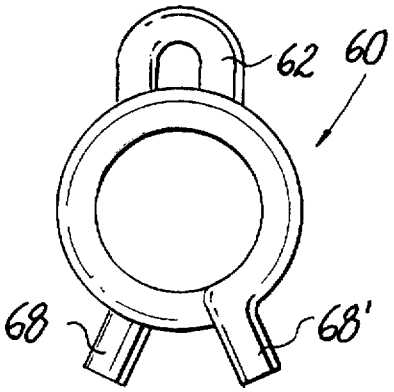
FIG. 10 is an end view of the spring of FIG. 8.
Figure 9:
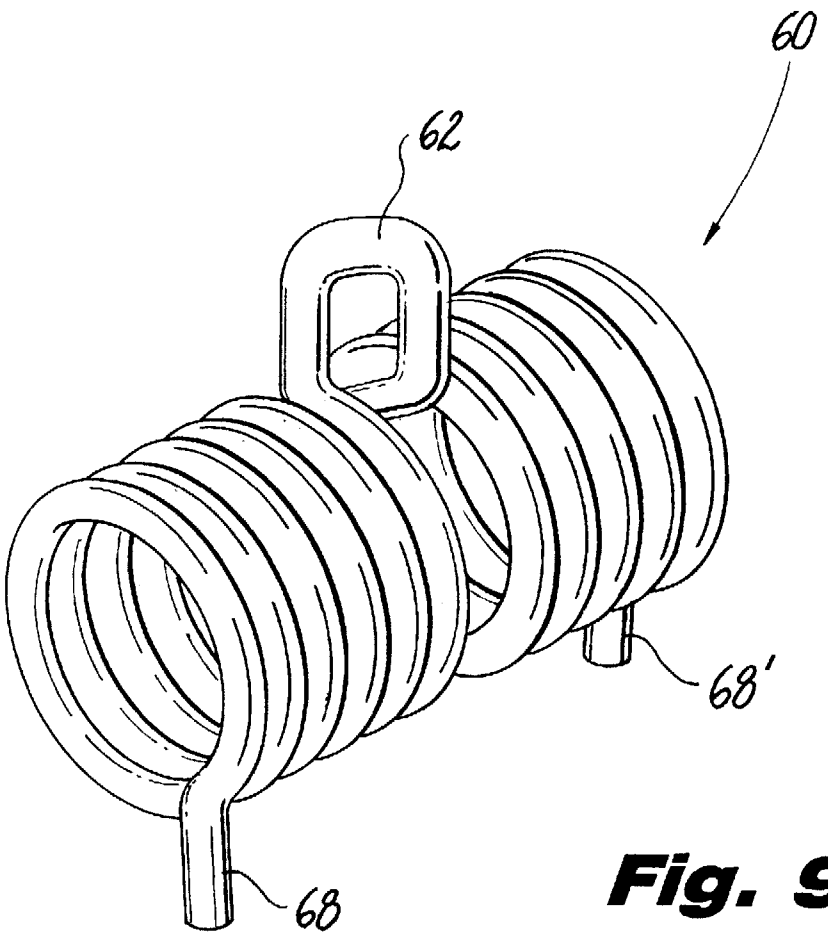
FIG. 9 is a perspective view of the spring of FIG. 8.

In yet another embodiment of the invention, spring 60 is shown in FIGS. 8, 9 and 10 may be adapted to replace tandem springs 200, 200' shown in FIG. 3. In the replacements, anchor fold 62 is oriented to fit aperture 12 or slot 103 respectively; and outer radial extensions 68, 68' are oriented circumferentially to fit slot 6 or slot 104 respectively.

In yet another embodiment of the invention, a spring of generally uniform coils between the radial extensions at the ends of the springs, as spring 60 less an anchor extension, is used. This may cause slight buckling in a relatively long spring resulting in slight localized lateral pressure on shaft component 8 as the radial extensions of the spring are circumferentially displaced toward and away from one another. This could slightly increase friction with the shaft component upon installation and removal of the knob.

Spring 60 may be adapted for providing the above described spring wound in two directions by fold 62 reversing the direction of one side of the twist.

Figure 4:
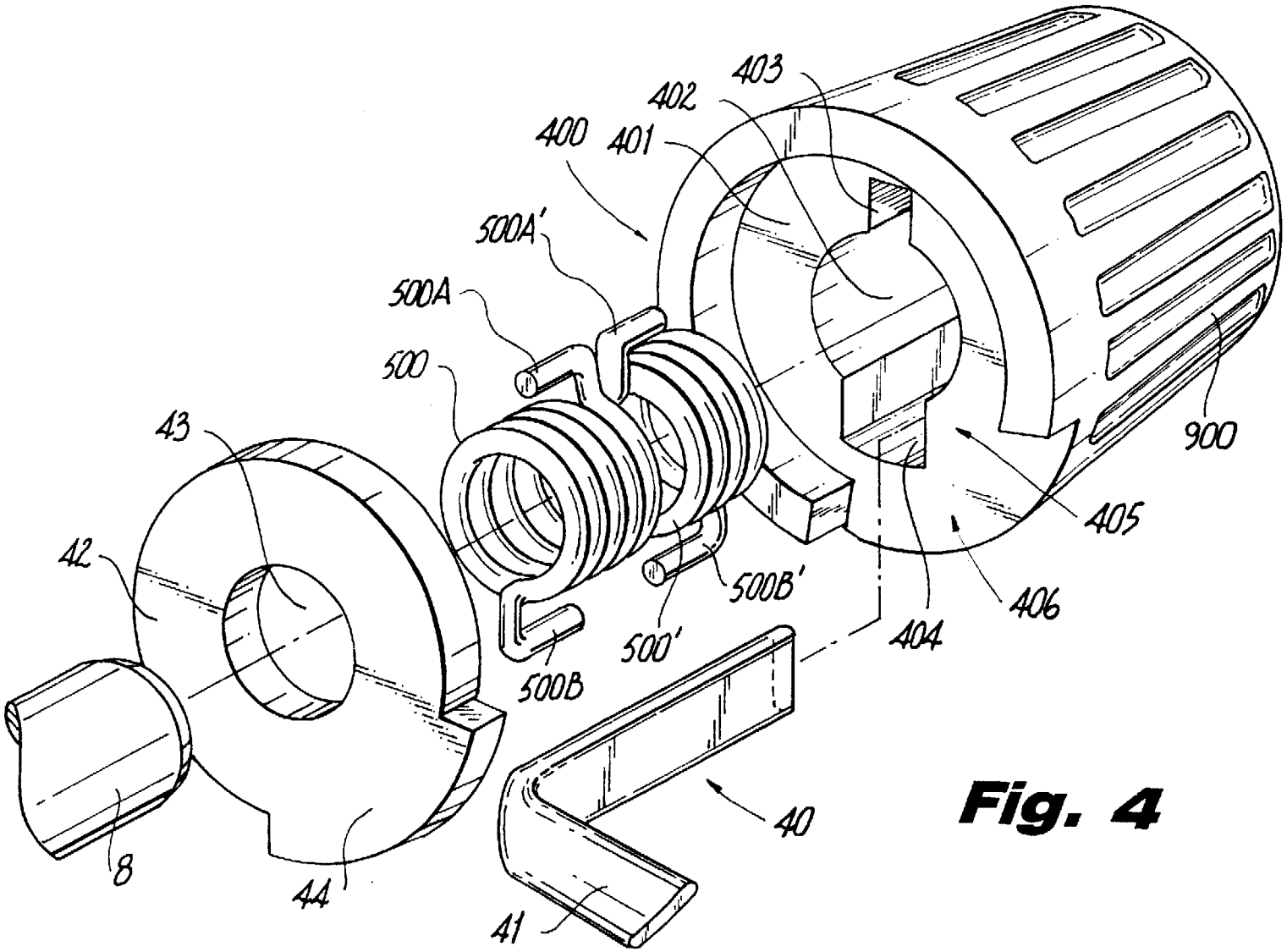
FIG. 4 is an exploded perspective view of a knob incorporating another alternate construction in accordance with the invention.
Figure 5:
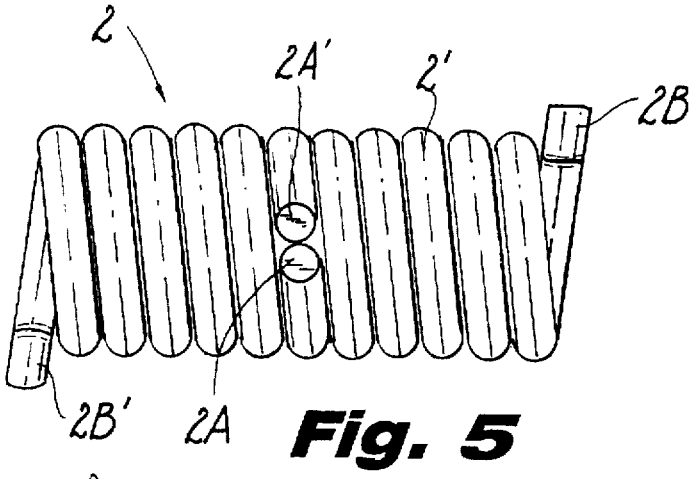
FIG. 5 is a top elevational view of two torsion multi-turned coiled springs arranged for use in the fabrication of the knob of FIG. 1.
Figure 6:
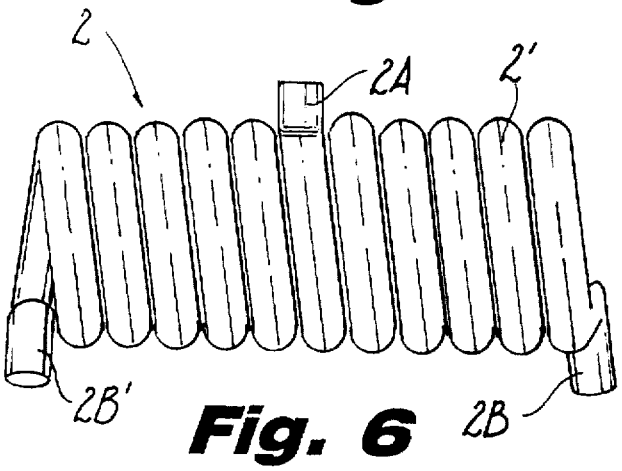
FIG. 6 is a side elevational view of the springs of FIG. 5.

Referring now to FIG. 4, another preferred embodiment of the present invention is shown where the knob 40 has its outer knob portion 900 and inner housing portion 401 are molded as one piece with a central bore 402 which houses a pair of locking torsion springs 500, 500'. Two axially positioned slots 403, 404 communicate with the bore 402, run parallel to the bore and are positioned 180°. apart from one another.

The pair of torsion springs 500, 500' are positioned in tandem in the bore and as in the previously discussed constructions, are closed wound with radial extensions at their inner and outer ends 500A, 500A', 500B, 500B'. In the construction of FIG. 4, the inner and outer radial extensions are bent to extend axially within slots 403, 404. As in previously discussed constructions, the springs have an inside diameter slightly smaller than the shaft component to which they will attach.

The inner adjacent extensions of the springs fit within slot 403 which clamps the extensions thereby restricting their movement to the necessary radial expansion movements for releasing and receiving the shaft.

The outer extensions are clocked to be slightly circumferentially spaced and are accommodated within slot 404. The slot 404 is enlarged so as to accommodate both the outer extensions of the springs and the axially extending flat portion of key bar 316 which is positioned over/under the outer axial extensions of springs such that applying rotational movement to key 40 through rotating key handle 41 causes flat surfaces of the key to rotate the outer spring ends in angularly opposite directions to increase the inner diameter of springs. The shaft 8 may then be inserted in the springs along the axis thereof. When pressure is removed from the key, the bias of the springs causes the pair of spring ends to return to their normal position, tightened about the shaft when the shaft is inserted.

The retainer wall 42 which has an aperture 43 to accommodate the shaft 8 is circumferentially contoured to friction fit within space 405 at the inner end of knob 40 where it retains the springs within bore 402, and to form part of the inner end of the knob with an extended arcuate portion 44.

When the retainer wall is seated, there is a space between the back of the retainer wall and the inner end of the knob to provide an actuation slot 406 to accommodate the movement of the handle 41 of key 40.

It should be understood that the above description discloses a specific embodiment of the present invention or specific embodiments of the present invention and are for the purpose of illustration only. There may be other modifications and changes obvious to those having ordinary skill in the art which fall within the scope of the present invention which should be limited only by the following claims and their legal equivalence.

What is claimed is:

1. A knob assembly comprising a housing, coiled spring means with radially extending ends and predetermined outer diameter mounted in said housing, said coiled spring means defining an annulus extending along a center axis with predetermined inner diameter that is normally smaller than the predetermined diameter of a shaft component on which the knob is to be mounted; one of said ends being secured for limited radial movement and against rotational and axial movement with respect to a first portion of said housing and the other of said ends being secured for limited rotational movement with respect to a second portion of said housing said second portion being fixed to said first portion against rotation of said second portion relative to said first portion, means in said housing for rotating said other of said ends for increasing said diameters of said coiled spring means, said inner diameter of said coiled spring means when increased being larger than the predetermined diameter of the shaft component and said one of said ends and said other of said ends being movable axially with respect to the shaft component when the shaft component is in the coiled spring means.

2. The knob assembly of claim 1 wherein access is provided in said housing for a tool to actuate said rotating means.

3. The knob assembly according to claim 1 wherein said coiled spring means comprises a single coiled spring having a multiplicity of adjacent coils extending along said axis between end coils, said one of said ends comprises radially extending folded coil intermediate said end coils and said other of said ends comprises linear extensions of said end coils, first groove means in said housing for securing said one of said ends, and second groove means in said housing for securing said other of said ends.

4. The knob assembly of claim 1 further comprising said coiled spring means comprising a pair of coiled springs arranged in tandem in said housing, said housing mounting and securing said one of said ends of each of said pair of coiled springs in adjacency and mounting and securing said other of said ends of each of said pair of coiled springs axially and circumferentially spaced apart, and said rotating means comprising means for simultaneously moving each of said other of said ends in opposite rotational directions, said housing having a first end and a second end, said first end of said housing extending over one of the springs of said pair of coiled springs, said second end of said housing extending over the other spring of said pair of coiled springs and being fixed to said first end of said housing against rotation of said second end of said housing relative to said first end of said housing.

5. The knob assembly of claim 4 wherein access is provided in said housing for a tool to actuate said rotating means.

6. The knob assembly of claim 4 further comprising an axial extending slot in said housing for mounting and securing said other of said ends of each of said pair of coiled springs for limited rotational movement, said knob being mounted on said shaft component extending axially continuously within both springs of said pair of coiled springs.

7. The knob assembly of claim 6 wherein access is provided in said housing for a tool to actuate said rotating means.

8. A knob assembly including means for receiving, locking and releasing a shaft having a predetermined outer diameter, said knob comprising coiled spring means with radially extending ends, said coiled spring means defining an annulus extending along a center axis with predetermined inner and outer diameters; means mounting said spring means for securing one of said ends for limited radial movement and against rotational and axial movement and for securing the other of said ends for limited rotational movement, said mounting means comprising a knob housing and means in said housing for rotating said other of said ends for increasing said diameters of said coiled spring means, said predetermined inner diameter of said coiled spring means being predetermined to be smaller than said predetermined diameter of the shaft, said inner diameter of said coiled spring means when increased comprising means for receiving said shaft having said predetermined outer diameter, said coiled spring means comprising a pair of coiled springs arranged in tandem in said housing, said mounting and securing means mounting and securing said one of said ends of each of said pair of coiled springs in adjacency and mounting and securing said other of said ends of each of said pair of coiled springs axially and circumferentially spaced apart, and said rotating means comprising means for simultaneously moving each of said other of said ends in opposite rotational directions, said mounting and securing means including an axial extending slot in said housing for mounting and securing said other of said ends of each of said pair of coiled springs for limited rotational movement, fulcrum means extending centrally of said slot and said rotating means comprising a see-saw lever mounted in said slot and on said fulcrum means, said see-saw lever including ends contacting each of said other of said ends for rotating said contacted ends when said see-saw lever is pivoted on said fulcrum means.

9. The knob assembly of claim 8 wherein access is provided in said housing for a tool to pivot said lever.

10. A knob assembly including means for receiving, locking and releasing a shaft having a predetermined outer diameter, said knob comprising coiled spring means with radially extending ends, said coiled spring means defining an annulus extending along a center axis with predetermined inner and outer diameters; means mounting said spring means for securing one of said ends for limited radial movement and against rotational and axial movement and for securing the other of said ends for limited rotational movement, said mounting means comprising a knob housing and means in said housing for rotating said other of said ends for increasing said diameters of said coiled spring means, said predetermined inner diameter of said coiled spring means being predetermined to be smaller than said predetermined diameter of the shaft, said inner diameter of said coiled spring means when increased comprising means for receiving said shaft having said predetermined outer diameter, said coiled spring means comprising a pair of coiled springs arranged in tandem in said housing, said mounting and securing means mounting and securing said one of said ends of each of said pair of coiled springs in adjacency and mounting and securing said other of said ends of each of said pair of coiled springs axially and circumferentially spaced apart, and said rotating means comprising means for simultaneously moving each of said other of said ends in opposite rotational directions, said mounting and securing means including an axial extending slot in said housing for mounting and securing said other of said ends of each of said pair of coiled springs for limited rotational movement, said rotating means comprising a bar extending axially in said slot and rotatable about a long axis, said bar having ends for contacting said other of said ends of each of said pair of coiled springs for rotating said contacted ends in opposite directions when said bar is rotated.

11. The knob assembly of claim 10 wherein said bar further comprises a handle extending outside said housing through a slot in said housing permitting movement of said handle to rotate said bar.

12. The knob assembly of claim 10 wherein said ends of said bar are notched to accommodate said other of said ends of said pair of coiled springs.

13. The knob assembly of claim 12 wherein one of said ends of said bar is formed with a tool mating end and said housing provides access for a tool for actuating said rotating means.

14. A knob assembly including means for receiving, locking and releasing a shaft having a predetermined outer diameter, said knob comprising coiled spring means with radially extending ends, said coiled spring means defining an annulus extending along a center axis with predetermined inner and outer diameters; means mounting said spring means for securing one of said ends for limited radial movement and against rotational and axial movement and for securing the other of said ends for limited rotational movement, said mounting means comprising a housing and means in said housing for rotating said other of said ends for increasing said diameters of said coiled spring means, said predetermined inner diameter of said coiled spring means being predetermined to be smaller than said predetermined diameter of the shaft, said inner diameter of said coiled spring means when increased comprising means for receiving said shaft having said predetermined outer diameter, said housing being an inner housing comprised of mating halves for assembling said spring means and said knob assembly further comprising an outer housing, said inner housing fitting within said outer housing.

15. The knob assembly of claim 14 wherein access is provided in said inner and outer housings for a tool to actuate said rotating means.

16. Apparatus for securing a hub to a shaft having a predetermined outer diameter, said apparatus comprising coiled spring means with radially extending ends, said coiled spring means defining an annulus extending along a center axis with predetermined inner and outer diameters, said predetermined inner diameter of said coiled spring means being predetermined to be smaller than said predetermined diameter of said shaft, means mounting said coiled spring means for securing one of said ends for limited radial movement and against rotational and axial movement and for securing the other of said ends for limited rotational movement, said mounting means comprising a housing and means in said housing for rotating said other of said ends for increasing said diameters of said coiled spring means, said coiled spring means, when said inner diameter of said coiled spring means is increased, comprising means for receiving said shaft having said predetermined outer diameter and said one of said ends and said other of said ends being movable axially with respect to the shaft when the shaft is received by said means for receiving said shaft.

17. The apparatus of claim 16 wherein said coiled spring means comprises a pair of coiled springs arranged in tandem in said housing, said mounting and securing means mounting and securing said one of said ends of each of said pair of coiled springs in adjacency and mounting and securing said other of said ends of each of said pair of coiled springs axially and circumferentially spaced apart, and said rotating means comprises means for simultaneously moving each of said other of said ends in opposite rotational directions, said coiled spring means being mounted on said shaft extending axially within both springs of said pair of coiled springs.

18. The apparatus for securing a hub according to claim 16 wherein said coiled spring means comprises a single coiled spring having a multiplicity of adjacent coils extending along said axis between end coils, said one of said ends comprises a radially extending folded coil intermediate said end coils and said other of said ends comprises linear extensions of said end coils, first groove means in said housing for securing said one of said ends, and second groove means in said housing for securing said other of said ends.

* * * * *